US006388238B2

(12) United States Patent
Head

(10) Patent No.: US 6,388,238 B2
(45) Date of Patent: May 14, 2002

(54) MICROWAVE OVEN CONTROL WITH EXTERNAL MEMORY CONTROL DATA

(75) Inventor: Jesse S. Head, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/224,331

(22) Filed: Dec. 31, 1998

(51) Int. Cl.[7] ..... H05B 6/66
(52) U.S. Cl. ..... 219/702; 219/714
(58) Field of Search ..... 219/702, 482, 219/506, 508, 714, 715, 716, 720, 703, 710, 719; 99/325; 126/39 R, 299 R, 299 F; 700/15

(56) References Cited

U.S. PATENT DOCUMENTS

| | | | | | |
|---|---|---|---|---|---|
| 4,841,125 | A | * | 6/1989 | Edamura | 219/506 |
| 5,272,300 | A | * | 12/1993 | Edamura | 219/702 |
| 5,317,134 | A | * | 5/1994 | Edamura | 219/720 |
| 5,642,268 | A | * | 6/1997 | Pratt et al. | 363/17 |
| 5,812,393 | A | * | 9/1998 | Drucker | 700/15 |
| 5,892,826 | A | * | 4/1999 | Brown et al. | 380/4 |

FOREIGN PATENT DOCUMENTS

| | | | |
|---|---|---|---|
| JP | 62063484 | * | 3/1987 |
| JP | 3-246882 | * | 11/1991 |
| JP | 08241789 | * | 9/1996 |
| JP | 09184634 | * | 7/1997 |

* cited by examiner

*Primary Examiner*—Tu Ba Hoang
(74) *Attorney, Agent, or Firm*—Armstrong Teasdale LLP

(57) ABSTRACT

A microwave control unit that includes an external memory storage for storing, for example, control parameters, cooking parameters, and feature data is described. In one embodiment, the control unit includes a pre-programmed microprocessor coupled to a key panel and a display. The controller also is coupled, for example, to a power supply, sensors, and power switches. The control microprocessor, as is known in the art, includes an on-board memory unit, e.g., a read only memory, for storing the control program as well as control parameters, cooking parameters, and feature data. Under the control of the control program, the microprocessor is configured to control, for example, energy output levels and cooking time based on the operator inputs. The control unit also includes an external model configuration read only memory (EMCR) coupled to the control microprocessor via an external bus. The EMCR also has control parameters, cooking parameters, and feature data stored therein. The parameters and data stored in the EMCR can differ in many respects from the control program stored in the on-board memory.

17 Claims, 2 Drawing Sheets

MICROWAVE OVEN CONTROL WITH EXTERNAL MEMORY CONTROL DATA

BACKGROUND OF THE INVENTION

This invention relates generally to microwave and convection ovens, and more specifically, to methods and apparatus for configuring oven controls.

Known microwave ovens include a programmable controller, such as a microprocessor, for controlling oven operations based on operator inputs. Such microprocessors include a read only memory (ROM) unit, sometimes referred to herein as an on-board ROM. The control program is stored in the on-board ROM. Control parameters, cooking parameters, and features data also are stored in the on-board ROM. An exemplary control parameter is a bit set to one or zero to indicate whether a sound, or beep, feature of the microwave should be activated, i.e., on/off. Exemplary cooking parameters include preprogrammed cooking algorithms designating power levels and times. Exemplary features data include data relating to key panel features, such as a POPCORN feature which enables an operator to simply select POPCORN on the key panel to cook popcorn.

Since different model microwave ovens typically have different characteristics such as different cavity sizes, output powers, and control features, the control and cooking parameters and data vary for each model. If any changes are desired or required to the control parameters, cooking parameters, or feature data, the microprocessor supplier generally must fabricate a microprocessor having the modified parameters and data stored in the on-board ROM. Incorporating such changes into the on-board ROM often takes many weeks to complete. Such delay may result in lost sales due to customer demands for certain modifications.

For example, if a particular model requires a BAGEL feature rather than a POPCORN feature, the parameters and data stored in the on-board ROM must be changed. Making such changes to the on-board ROM, however, can take weeks to complete.

Some microprocessor fabricators do offer special microprocessors for more quickly incorporating changes into the on-board ROM. Such special microprocessors, however, are much more expensive than the standard production processors. Especially in high volume production, such as with microwave ovens, the added costs associated with the more expensive microprocessors typically prohibits use of such processors.

It would be desirable to provide a controller for use in microwave ovens that enables changes to be quickly made to the control parameters, cooking parameters, and feature data, yet which also does not have prohibitive costs.

BRIEF SUMMARY OF THE INVENTION

These and other objects may be attained by a control unit that includes an external memory storage for storing replacement control parameters, cooking parameters, and feature data for a microwave oven. More particularly, and in one embodiment, the control unit includes a pre-programmed microprocessor coupled to a key panel and a display. The controller also is coupled, for example, to a power supply, sensors, and power switches.

The control microprocessor, as is known in the art, includes an on-board memory unit, e.g., a read only memory (ROM), for storing the control program. Control parameters, cooking parameters, and feature data also are stored in the on-board ROM. Under the control of the control program, and using the parameters and data stored in the on-board ROM, the microprocessor is configured to control, for example, energy output levels and cooking time based on the operator inputs.

The control unit may also include an external model configuration read only memory (EMCR) coupled to the control microprocessor via an external bus. The EMCR also has control parameters, cooking parameters, and feature data stored therein. The parameters and data stored in the EMCR can differ in many respects from the parameters and data stored in the on-board memory.

The control microprocessor and the EMCR, in one embodiment, are located on a printed circuit board. The EMCR is removably inserted into a plug connector which is electrically connected to the microprocessor. In operation, and upon initialization of the control microprocessor, the microprocessor attempts to read parameters or data from the EMCR. If the EMCR has been inserted into the connector, the attempt to read from the EMCR will be successful and the processor then uses the parameters and data stored on the EMCR. If the attempt to read from the EMCR is not successful, then the EMCR has not been inserted into the connector and the processor uses the parameters and data stored in the on-board ROM.

The above described control unit enables making changes to microwave oven operations by simply installing an EMCR having the parameters and data stored therein. The EMCR stored parameters and data can be used on models fabricated while a new processor is being designed/revised, tested, and fabricated. Once the new processor is available, then the EMCR is not needed, i.e., the EMCR is no longer installed on circuit boards fabricated subsequent to availability of the new processor. The control unit therefore enables fast and easy conversion to modified parameters and data, and is believed to be less expensive than using specialized processors that allow for reconfiguration of the parameters and data stored in the on-board memory.

DETAILED DESCRIPTION OF THE INVENTION

Figure 1:
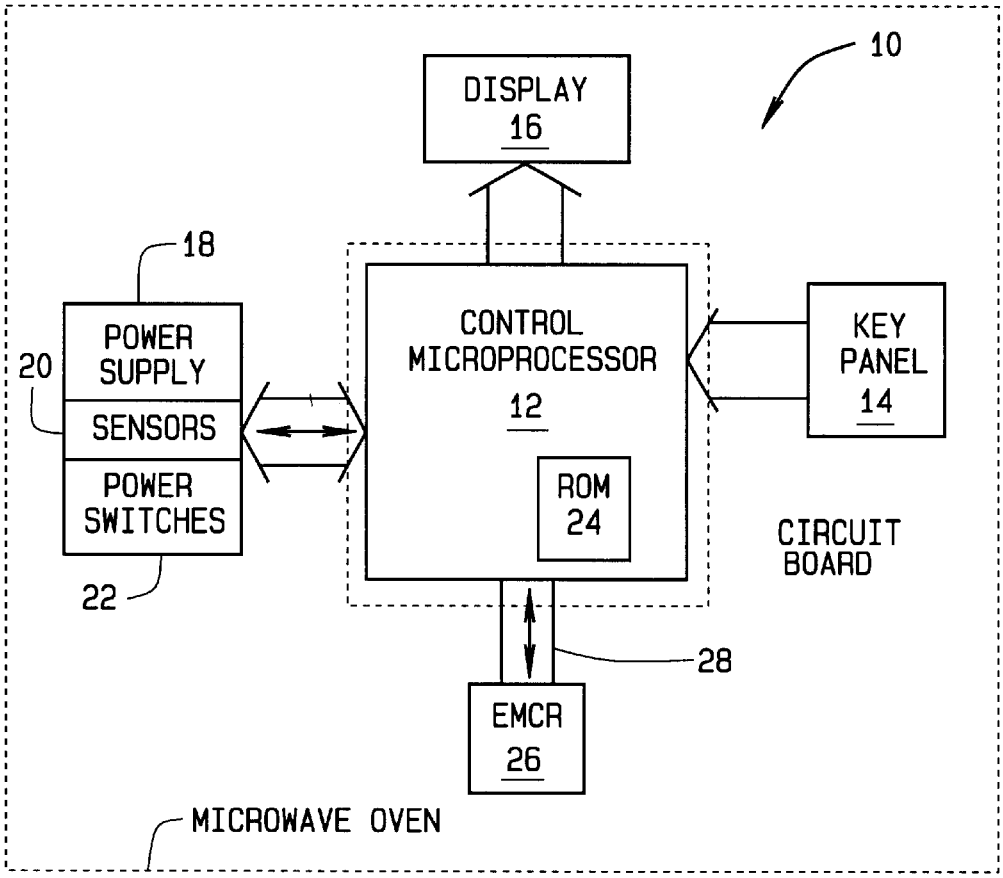
FIG. 1 is a block diagram of a control unit of a microwave oven, including an external memory.

FIG. 1 is a block diagram of a control unit 10 for a microwave or convection type oven. Control unit 10 includes a pre-programmed controller, or control microprocessor 12, coupled to a key panel 14 and a display 16. An operator may input instructions to controller 12 via key panel 14, and certain messages and data are displayed by controller 12 on display 16. For example, the remaining time in a cooking cycle may be displayed by controller 12 on display 16. Controller 12 also is coupled, for example, to a power supply 18, sensors 20, and power switches 22. Instructions input by an operator at key panel 14 are utilized by controller 12 in controlling cooking operations. Temperature representative signals are provided to controller 12 by sensors 20 so that controller 12 can determine whether the desired operation is being achieved. Controller 12 includes an on-board memory unit, e.g., read only memory 24, for storing a control program, control parameters, cooking parameters, and feature data.

Control unit 10 also includes an external model configuration read only memory (EMCR) 26 coupled to control microprocessor 12 via an external bus 28. More particularly, EMCR 26 is configured for serial communications with processsor 12, which provides the advantage that only two lines are needed for connecting EMCR 26 to processor 12. EMCR 26 has control parameters, cooking parameters, and feature data stored therein. The parameters and data stored in EMCR 26 can differ in many respects from the parameters and data stored in the on-board memory.

To simplify processing as described below in more detail, EMCR 26 contains a complete set of parameters and data. Therefore, when EMCR 26 is installed, processor 12 uses only the parameters and data in EMCR 26. When EMCR 26 is not installed, processor 12 uses only the parameters and data stored in ROM 24.

As an example of changes that can be effected by use of EMCR 26, the original microwave ovens may include a "POPCORN" select feature on key panel 14 so that an operator can simply select "POPCORN" and the oven will operate in accordance with a pre-programmed (e.g., power level and time) cooking routine. A particular model may, however, require a "BAGEL" select feature. Therefore, the key panel can be modified to substitute a "BAGEL" key pad for a "POPCORN" key pad. In addition, EMCR 26 would contain the appropriate parameters and data so that the proper power level and cook times for a bagel are provided. Controls that may be added or revised include, for example, cooking feature algorithms and times, alternative feature operations (e.g., different beeper signal options), and enabling/disabling features.

EMCR 26 may be a read only memory (ROM), such as an electronically erasable programmable read only memory (EEPROM). As is well known, an EEPROM provides the advantage of in-circuit programmability. The amount of storage available on EMCR 26 depends upon the number of parameters and data to be stored therein.

Control microprocessor 12 and EMCR 26 may, for example, be mounted on the same printed circuit board. The printed circuit board would include, for example, a socket connector for receiving EMCR 26, and EMCR 26 can be removably inserted into such socket connector when desired. EMCR 26, in one embodiment, is configured for serial communications with processor 12. Such serial communications provides the advantage that only two lines are needed to connect EMCR 26 to processor 12. Alternatively, EMCR 26 may be mounted directly to the circuit board.

Control unit 10 could be utilized in connection with many different types of ovens and in many alternative oven configurations. The oven could, for example, be a convection or microwave oven commercially available from General Electric Company, Louisville, Ky., 40225. Such ovens may be modified to incorporate control unit 10.

Figure 2:
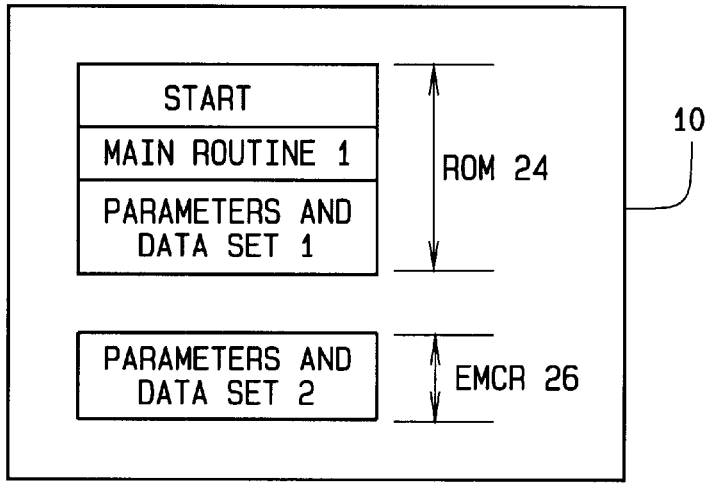
FIG. 2 illustrates memory allocations for the control unit shown in FIG. 1.

FIG. 2 illustrates an exemplary memory architecture or allocations for unit 10. Of course, many other architectures, or allocations, are possible. Referring to FIG. 2, a start or initialization routine, a main routine, i.e., main routine 1, and parameters and data i.e., parameters and data set 1, are stored in on-board ROM 24. A second set of parameters and data, i.e., parameters and data set 2, are stored in EMCR 26.

While it is contemplated that the data set to be used by processor 12 could be distributed between both ROM 24 and EMCR 26, it is much simpler for EMCR 26 to contain the entire set of parameters and data to be used. Processor 12 then executes its routines using only parameters and data from EMCR 26, rather than having to make additional decisions regarding where the data to be used is stored. In addition, the start routine, the main routine, and the parameter and data sets are illustrated as being in blocks of memory. Having the main routine located in one block of memory provides the advantage of simplifying testing and verification operations, however, it is not necessary for such routines and parameter and data sets to be located in separate memory blocks.

Figure 3:
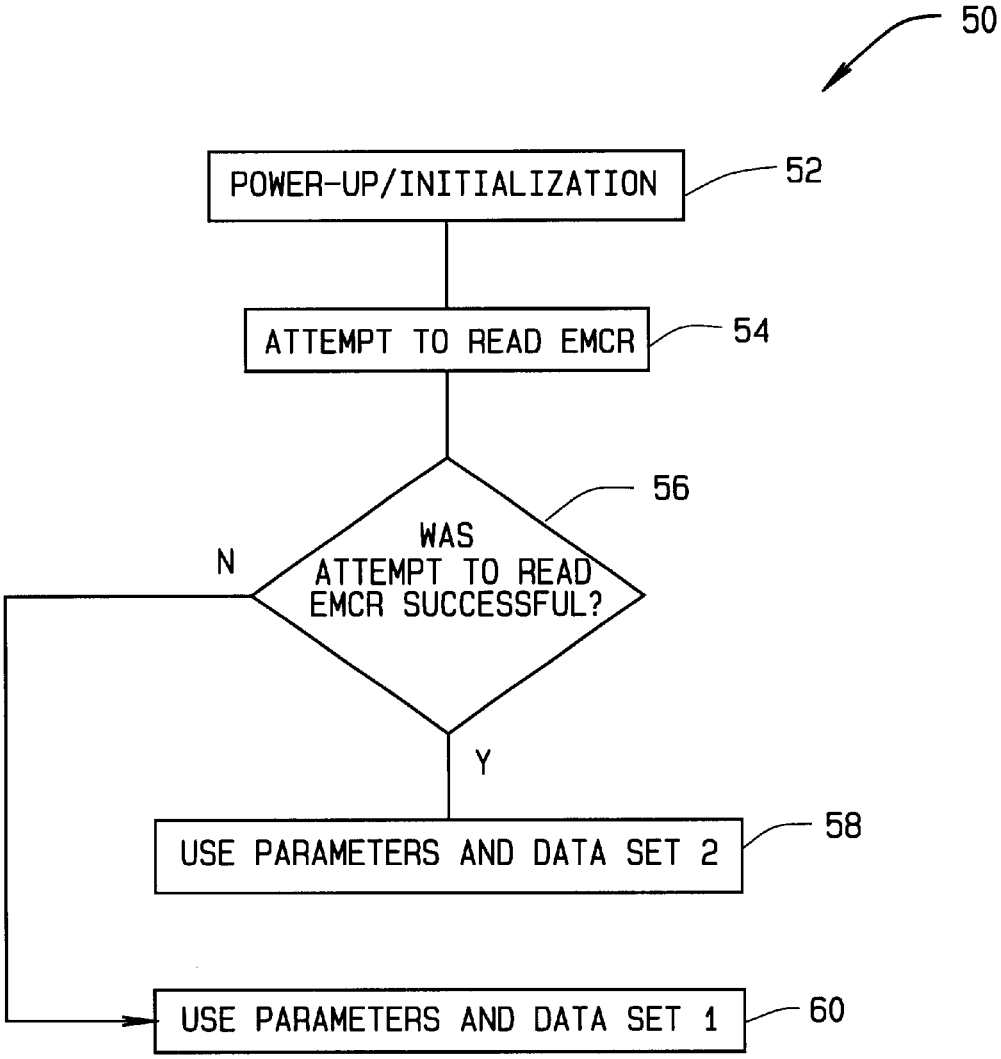
FIG. 3 is a flow chart of process steps executed by the control microprocessor shown in FIG. 1.

Referring now to FIG. 3, which is a flow chart 50 illustrating process steps executed by control microprocessor 12, and upon initialization 52 of control microprocessor 12, microprocessor 12 attempts to read 54 parameters or data from EMCR 26. If the attempt to read from EMCR 26 is successful 56, e.g., a requested parameter or data is returned, then processor 12 continues 58 with processing using the parameters and data set stored in EMCR 26. If the attempt is not successful, then processor 12 uses 60 the parameters and data stored in on-board ROM 24.

The above described control unit enables the EMCR to be used while a new processor is being designed/revised, tested, and fabricated. Once the new processor is available, then the EMCR is not needed (i.e., the EMCR is no longer installed on the circuit board) and the new control program stored on the new processor is executed. The control unit therefore enables fast and easy conversion to modified parameters and data, and is believed to be less expensive than using specialized processors that allow for revisions to parameters and data stored in the on-board memory.

Alternatively, and rather than a total redesign and change-out of an existing processor, the EMCR can be used to revise or add just a few or maybe even just one function. Such an architecture enables creation of a base routine (e.g., main routine 1 in FIG. 2) with a supplemental routine (e.g., main routine 2 in FIG. 2). Both the base routine and the supplemental routine would be executed by the processor. Multiple supplemental routines could be generated and stored in EMCRs to enable reconfiguration of the processor control based on the oven model, rather than separate processor control programs for each model.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A microwave oven comprising a control microprocessor comprising a memory storage having a first set of parameters and data stored therein, and an external memory storage coupled to said microprocessor having a second set of parameters and data stored therein; said microprocessor configured to use only one of said memory storage and said external memory storage to control cooking operation.

2. A microwave in accordance with claim 1 wherein said control microprocessor is programmed to determine whether said external memory storage is coupled thereto, and if said microprocessor determines that said external memory storage is coupled thereto, said microprocessor utilizes said second set of parameters and data.

3. A microwave in accordance with claim 1 wherein said control microprocessor is programmed to determine whether said external memory storage is coupled thereto, and if said microprocessor determines that said external memory storage is not coupled thereto, said microprocessor utilizes said first set of parameters and data.

4. A microwave in accordance with claim 1 wherein said control microprocessor is mounted on a circuit board, and said external memory storage is removably mounted to said circuit board.

5. A microwave in accordance with claim 1 further comprising a key panel coupled to said control microprocessor, a display coupled to said microprocessor, and a plurality of sensors coupled to said control microprocessor.

6. A microwave in accordance with claim 1 wherein said external memory storage comprises a read only memory.

7. A microwave in accordance with claim 6 wherein said read only memory comprises an electronically erasable programmable read only memory.

8. A microwave oven comprising a control microprocessor comprising an on-board memory storage and an external memory storage coupled to said microprocessor; said microprocessor configured to use only one of said on-board memory storage and said external memory storage to execute control routines.

9. A microwave in accordance with claim 8 wherein said control microprocessor is programmed to determine whether said external memory storage is coupled thereto.

10. A microwave in accordance with claim 9 wherein said external memory storage comprises at least one of data and parameters stored therein.

11. A microwave in accordance with claim 8 wherein said control microprocessor is programmed to determine whether said external memory storage is coupled thereto, and if said microprocessor determines that said external memory storage is not coupled thereto, said microprocessor utilizes data and parameters stored in said on-board memory.

12. A microwave in accordance with claim 8 wherein said control microprocessor is mounted on a circuit board, and said external memory storage is removably mounted to said circuit board.

13. A microwave in accordance with claim 8 further comprising a key panel coupled to said control microprocessor, a display coupled to said microprocessor, and a plurality of sensors coupled to said control microprocessor.

14. A microwave in accordance with claim 8 wherein said external memory storage comprises a read only memory.

15. A microwave in accordance with claim 14 wherein said read only memory comprises an electronically erasable programmable read only memory.

16. A microwave in accordance with claim 8 wherein said on-board memory storage comprises at least one of data and parameters stored therein, and wherein said external memory storage comprises at least one of data and parameters stored therein.

17. A microwave in accordance with claim 8 wherein said external memory storage comprises data and parameters stored therein, and said control processor executes a control program using said data and parameters stored in said external memory storage.

* * * * *